US007013761B2

(12) United States Patent
Chen

(10) Patent No.: US 7,013,761 B2
(45) Date of Patent: Mar. 21, 2006

(54) WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 131 days.

(21) Appl. No.: 10/770,686

(22) Filed: Feb. 2, 2004

(65) Prior Publication Data

US 2005/0166719 A1 Aug. 4, 2005

(51) Int. Cl.
*B25B 13/46* (2006.01)

(52) U.S. Cl. ..... 81/63; 81/61; 81/62

(58) Field of Classification Search ..... 81/63, 81/61, 62, 63.1, 63.2
See application file for complete search history.

(56) References Cited

U.S. PATENT DOCUMENTS 3,250,157 A * 5/1966 Badger ..... 81/63
6,109,140 A * 8/2000 Roberts et al. ..... 81/63
6,431,031 B1 * 8/2002 Hu ..... 81/63.2
6,568,298 B1 * 5/2003 Zinck ..... 81/57.13

* cited by examiner

*Primary Examiner*—Lee D. Wilson
*Assistant Examiner*—Alvin J. Grant
(74) *Attorney, Agent, or Firm*—Alan D. Kamrath; Nikolai & Mersereau, P.A.

(57) ABSTRACT

A wrench includes a body, a control device, a pawl and a joint. The body includes a handle and a ring. The control device includes a disc pivotally received in the ring and a stem projecting from the disc and including upper, lower and intermediate sections. The pawl is connected with the disc and formed with a toothed end for engagement with the teeth of the ring and two arc-shaped sides. The joint includes a disc received in the ring, an insert installed beneath the disc, stops installed on the disc for selective engagement with the arc-shaped sides of the pawl, and a ball detent trapped in a hole defined in the insert for selective engagement with one of the intermediate and lower sections of the stem.

14 Claims, 7 Drawing Sheets

WRENCH

BACKGROUND OF INVENTION

1. Field of Invention

The present invention relates to a wrench that can be switched between a mode where it can drive a socket in a direction and another mode where it can drive the socket in an opposite direction.

2. Related Prior Art

Taiwanese Patent Publication No. 316514 discloses a wrench including a joint 21 for engagement with a socket, a ring 22 to which the joint 21 is attached, a pawl 23 installed on the joint 21, a ring 24, a rotational disk 25, a bolt 26, a ball 27 and a spring 28. The joint 21 includes a square insert 212 for insertion into a square hole defined in the socket and a spring-biased ball detent installed at the square insert 212 for engagement with the wall of the square hole. However, the spring-biased ball detent is not reliable. The joint 21 includes a ridge 211 formed thereon and a hole 215 defined in the ridge 211. A thread is formed on the wall of the hole 215. The ring 22 includes a plurality of teeth formed on an internal face thereof. The pawl 23 includes a toothed side for engagement with the teeth and a smooth side for contact with the ridge 211. The pawl 23 includes a hole 231 defined in a top face thereof. A heart-shaped ring 24 includes two ends 241 inserted in the hole 231. The rotational disk 25 includes a boss 251 formed on a bottom face thereof and a hole 253 defined therein. The boss 251 is engaged with the ring 24 so that rotation of the rotational disk 25 causes rotation of the pawl 23 through the ring 24. The spring 28 and the ball 27 are received in the hole 215. The bolt 26 is inserted through the hole 253 into the hole 215. A thread formed on the bolt 26 is engaged with the thread formed on the wall of the hole 215, thus completing assembly of the wrench. This wrench is deemed structurally complicated.

The present invention is therefore intended to obviate or at least alleviate the problems encountered in the prior art.

SUMMARY OF INVENTION

It is an objective of the present invention to provide a structurally simple wrench that can be switched between a mode where it can drive a socket in a direction and another mode where it can drive the socket in an opposite direction.

To achieve this objective, the present invention provides a wrench including a body, a control device, a pawl and a joint. The body includes a handle a ring formed at an end of the handle and having an internal face and a plurality of teeth formed on the internal face of the ring. The control device includes a disc pivotally received in the ring. The pawl is connected with the disc and formed with a toothed end for engagement with the teeth and two arc-shaped sides. The joint includes a disc rotationally received in the ring, two stops installed on the disc each for selective engagement with one of the arc-shaped sides of the pawl, an insert installed beneath the disc and a detent attached to the insert.

It is another objective of the present invention to provide a wrench with a controllable detent for holding a socket.

To achieve the first and second objectives, the present invention provides a wrench including a body, a control device, a pawl and a joint. The body includes a handle, a ring formed at an end of the handle and having an internal face and a plurality of teeth formed on the internal face of the ring. The control device includes a disc pivotally received in the ring and a stem projecting from the disc and including an upper section, a lower section and an intermediate section thinner than the lower section. The pawl is connected with the disc and formed with a toothed end for engagement with the teeth and two arc-shaped sides, with the pawl defining a slot. The joint includes a disc received in the ring, an insert installed beneath the disc, two stops installed on the disc each for selective engagement with one of the arc-shaped sides of the pawl, a hole defined in the disc and the insert, a hole defined in the insert and communicated with the hole and a ball detent trapped in the hole for selective engagement with one of the intermediate and lower sections of the stem.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
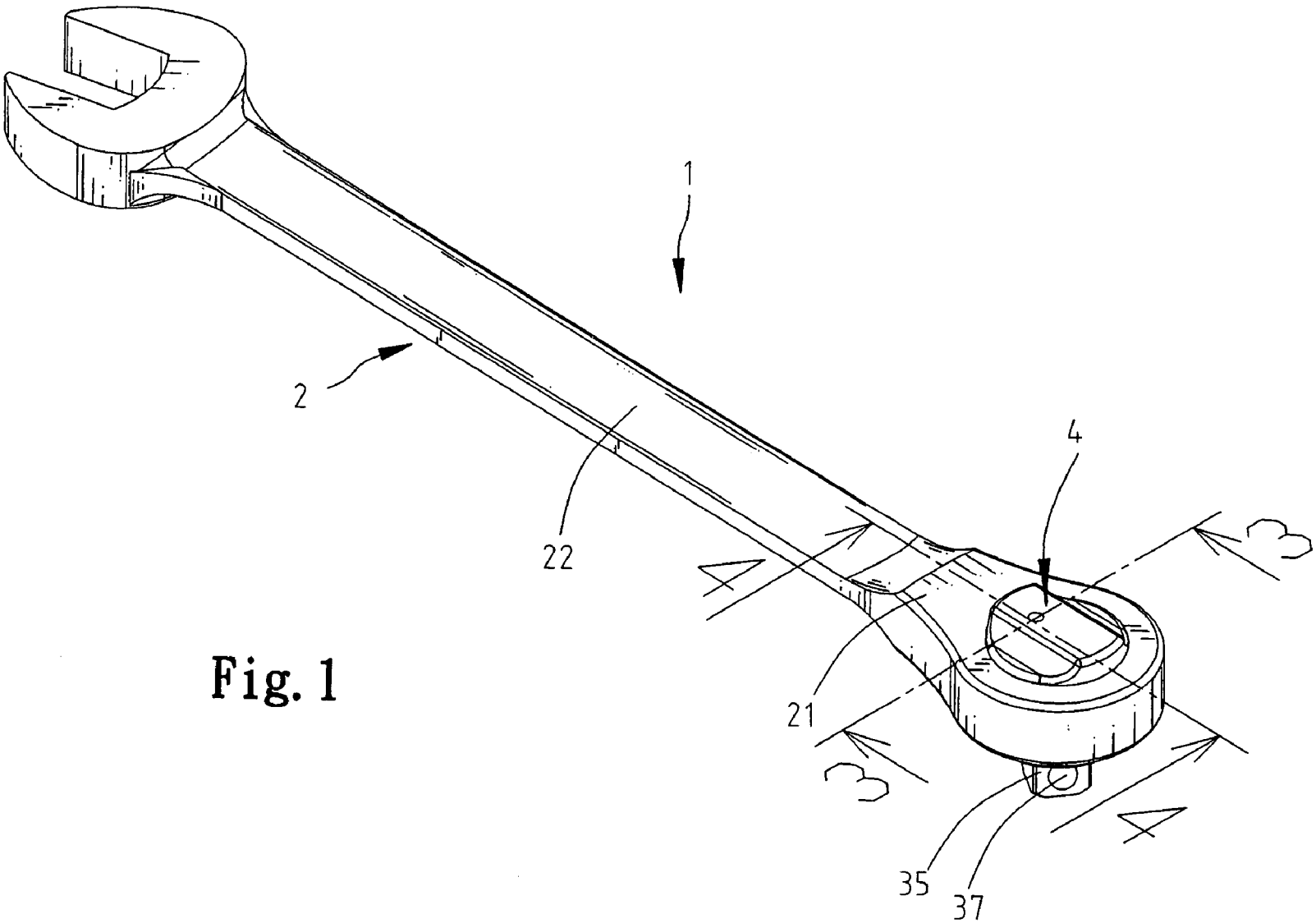
FIG. 1 is a perspective view of a wrench according to the present invention.

Referring to FIG. 1, a wrench 1 according to the preferred embodiment of the present invention is shown. The wrench 1 can be brought into engagement with sockets (not shown) of various sizes each adapted for engagement with a bolt or nut (not shown). Pivoting of the wrench 1 causes rotating of the bolt or nut.

Figure 2:
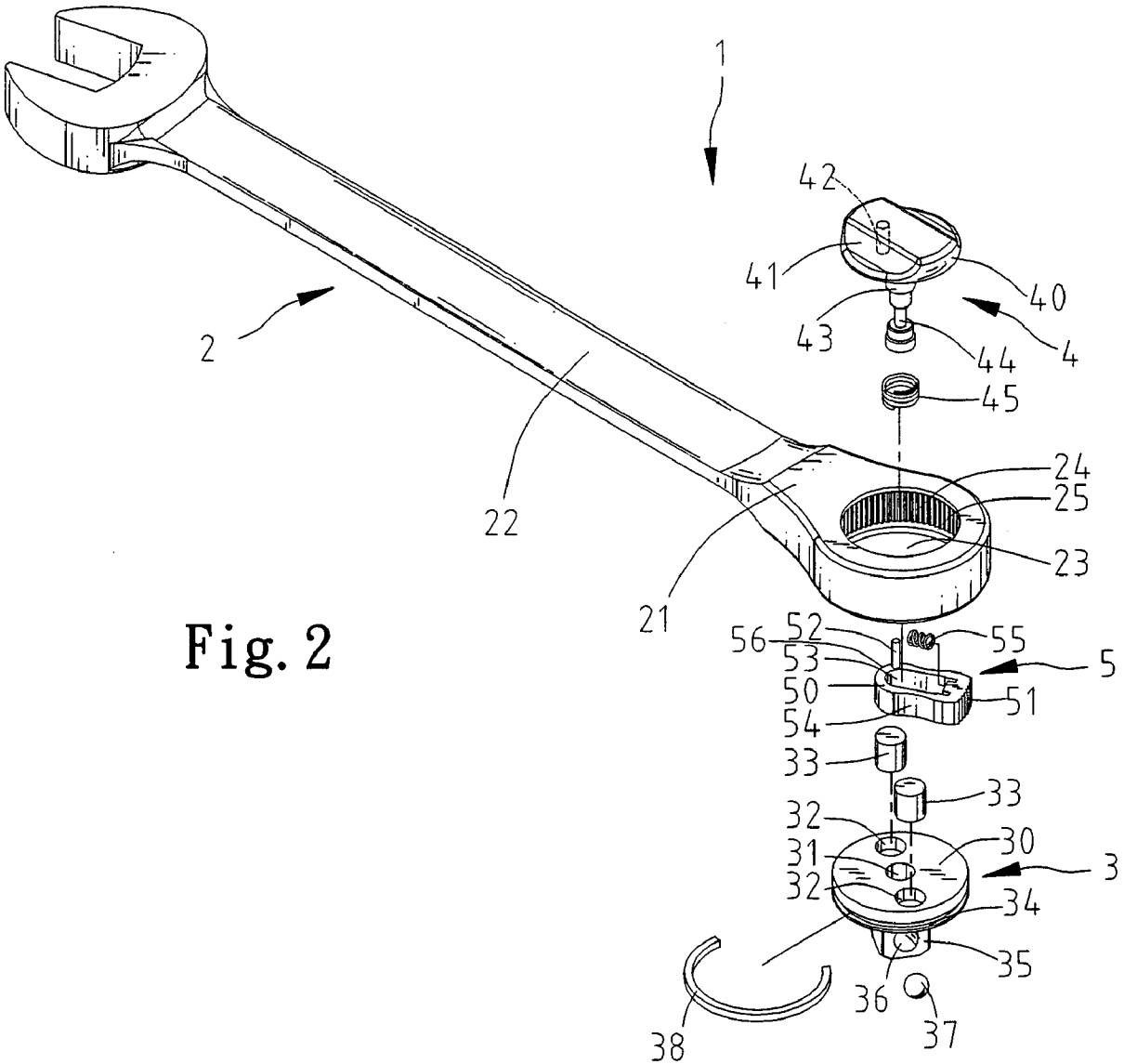
FIG. 2 is an exploded view of the wrench shown in FIG. 1.
Figure 3:
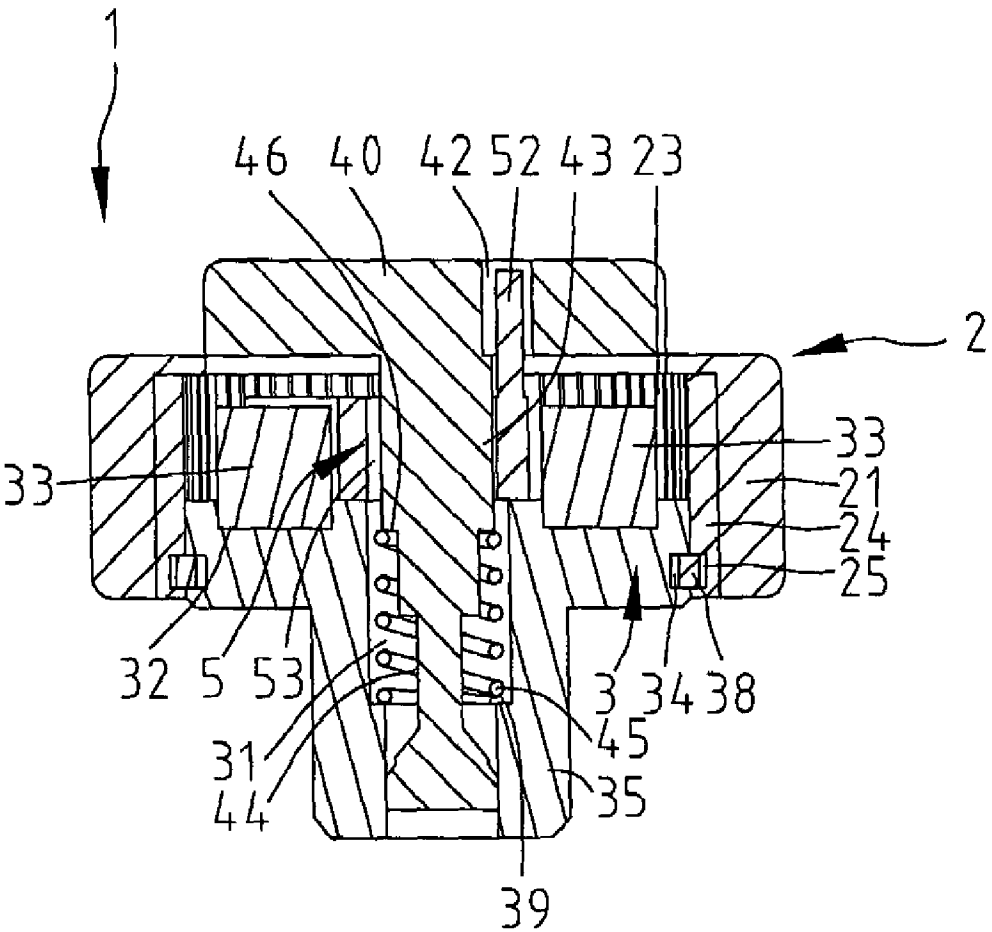
FIGS. 3 and 4 are cross-sectional views of the wrench shown in FIG. 1.
Figure 4:
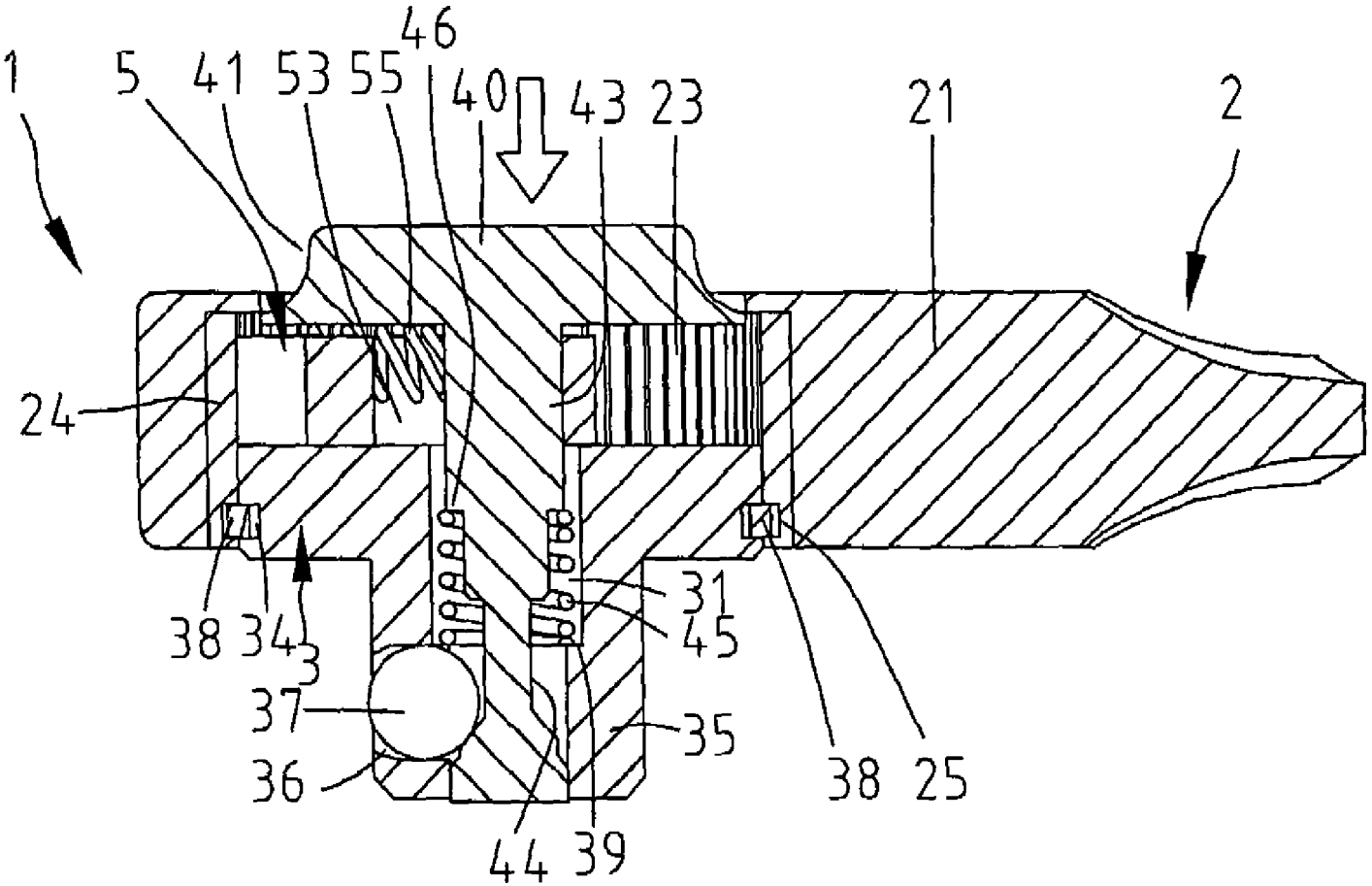

Referring to FIGS. 2~4, the wrench 1 includes a body 2, a joint 3, a control device 4 and a transmission device 5.

The body 2 includes a handle 22 and a ring 21 formed at an end of the handle 22. The ring 21 defines a space 23. A plurality of teeth 24 is formed on the wall of the space 23. An annular groove 25 is defined in the wall of the space 23.

The joint 3 includes a disc 30 with an annular groove 34 defined in its periphery. On a bottom face of the disc 30 is formed a square insert 35 for insertion into a square hole defined in a socket such as those discussed above. As shown in FIG. 4, the square insert 35 defines a hole 36 communicated with the hole 31. In a bottom face of the disc 30 are defined two holes 32 each for receiving a stop 33 and a hole 31 between the two holes 32. The hole 31 includes an upper section and a narrow lower section, thus forming an annular shoulder 39 between the sections thereof.

The transmission device 5 includes a pawl 50 and a spring 55. The pawl 50 includes a toothed end 51 and a smooth end 56. A rod 52 is formed on a top face of the pawl 50 near the smooth end 56 of the pawl 50. Moreover, the pawl 50 includes a slot 53 defined therein and two arc-shaped sides 54.

The control device 4 includes a disc 40 and a spring 45. On a top face of the disc 40 is formed a ridge 41 for engagement with fingers of a user trying to rotate the control device 4. On a bottom face of the disc 40 is defined a hole 42 and formed a stem 43. The stem 43 includes an upper section, a lower section and a narrow intermediate section 44 formed between the upper section and the lower section, thus forming an annular shoulder 46 formed between the upper section and the narrow intermediate section.

In assembly, an internal edge of a C-ring 38 is inserted into the annular groove 34, and an external edge of the C-ring 38 is inserted into the annular groove 25, thus retaining the disc 30 to the ring 21. The pawl 50 is put on the disc 30 between the stops 33. The spring 55 is received in the slot 53. The spring 45 is mounted on the stem 43 before the stem 43 is inserted through the slot 53 into the hole 31. The rod 52 is inserted in the hole 42. As best shown in FIG. 4, a ball detent 37 is forced into and retained in the hole 36 in a conventional manner. A portion of the ball detent 37 is received in the hole 31 for trapping the lower section of the stem 43.

When the assembly is completed, the spring 45 is compressed between the annular shoulders 39 and 46. Thus, the stem 43 is biased upward by the spring 45. Accordingly, a portion of the ball detent 37 is caused to extend from the hole 36 by the lower section of the stem 43. Moreover, the pawl 50 is pivotal on the disc 30, and the spring 55 is compressed between the stem 43 and a portion of the pawl 50. Pivoting of the ridge 41 causes pivoting of the pawl 50.

Referring to FIG. 4, a user pushes down the stem 43 so that the ball detent 37 can be further inserted into the hole 31, i.e., the ball detent 37 can be completely concealed in the holes 36 and 31. Thus, the square insert 35 can be inserted into a square hole defined in a socket. Then, the user releases the stem 43 so as to allow the spring 45 to move the stem 43 upward. Accordingly, the lower section of the stem 43 causes a portion of the ball detent 37 to extend from the hole 36 so as to retain the socket to the square insert 35.

Figure 5:
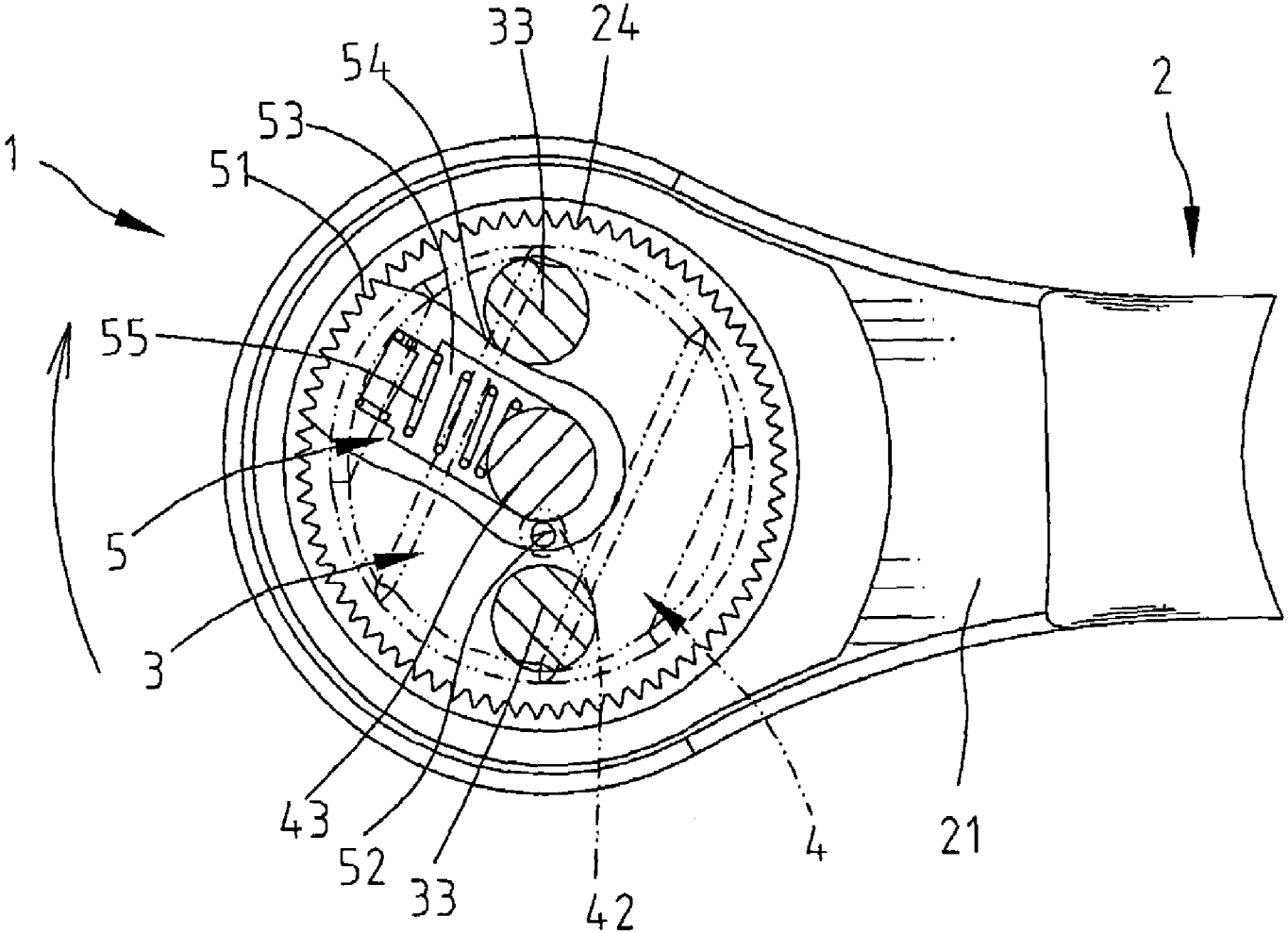
FIGS. 5~7 are top views of the wrench shown in FIG. 1.
Figure 6:
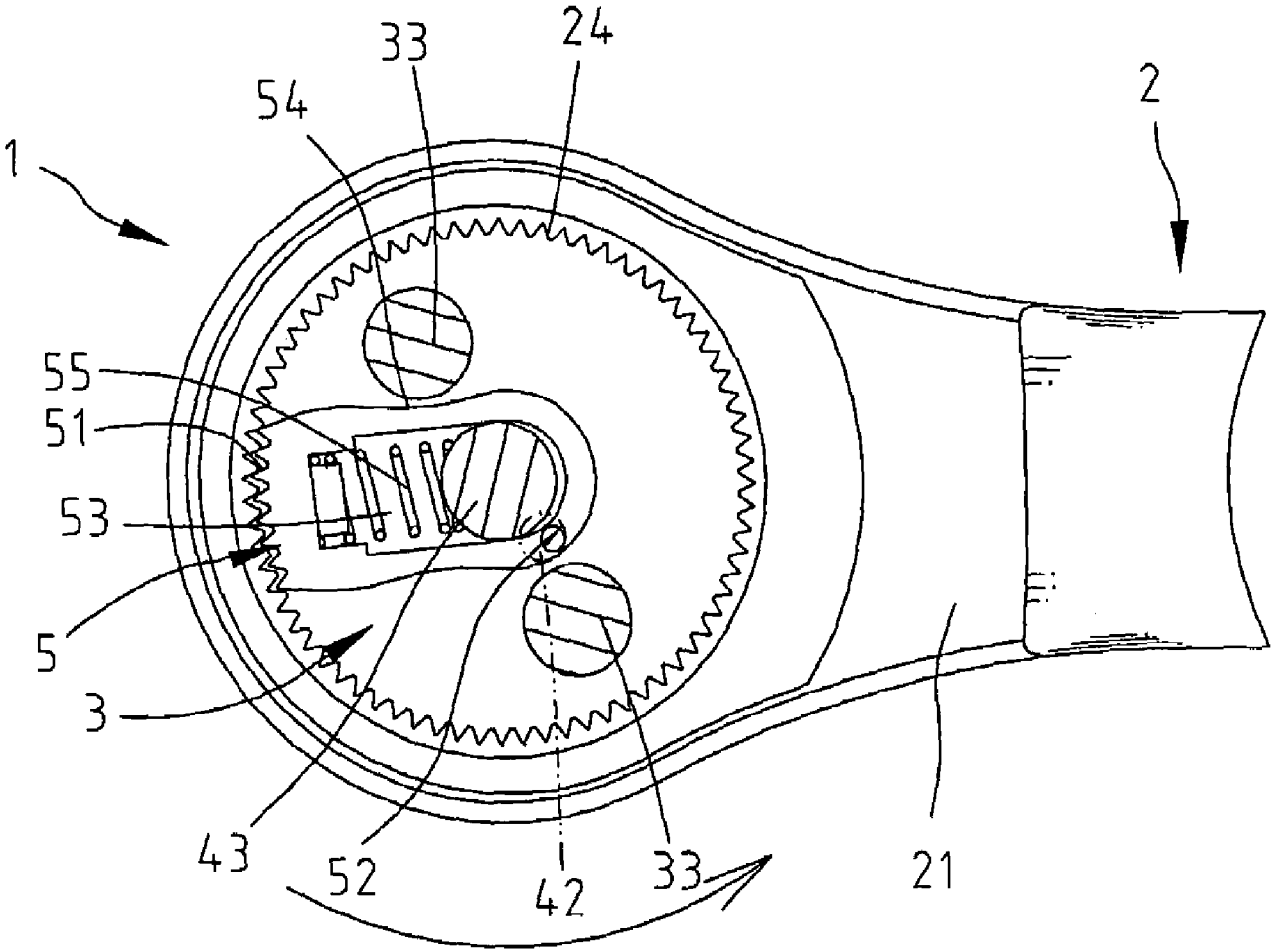

Referring to FIG. 5, to drive the bolt or nut clockwise, the user pivots the pawl 50 via pivoting the ridge 41. The right arch-shaped side 54 is engaged with the right stop 33 so as to avoid disengagement of the toothed end 51 of the pawl 50 from the teeth 24. Thus, clockwise pivoting of the pawl 50 causes clockwise pivoting of the square insert 35. However, counterclockwise pivoting of the pawl 50 does not cause counterclockwise pivoting of the square insert 35. Referring to FIG. 6, pivoting the body 2 counterclockwise, the user pivots the pawl 50 counterclockwise by a small angle so as to disengage the right side 54 from the right stop 33. Thus, further pivoting of the body 2 causes disengagement of the toothed end 51 of the pawl 50 from the teeth 24.

Figure 7:
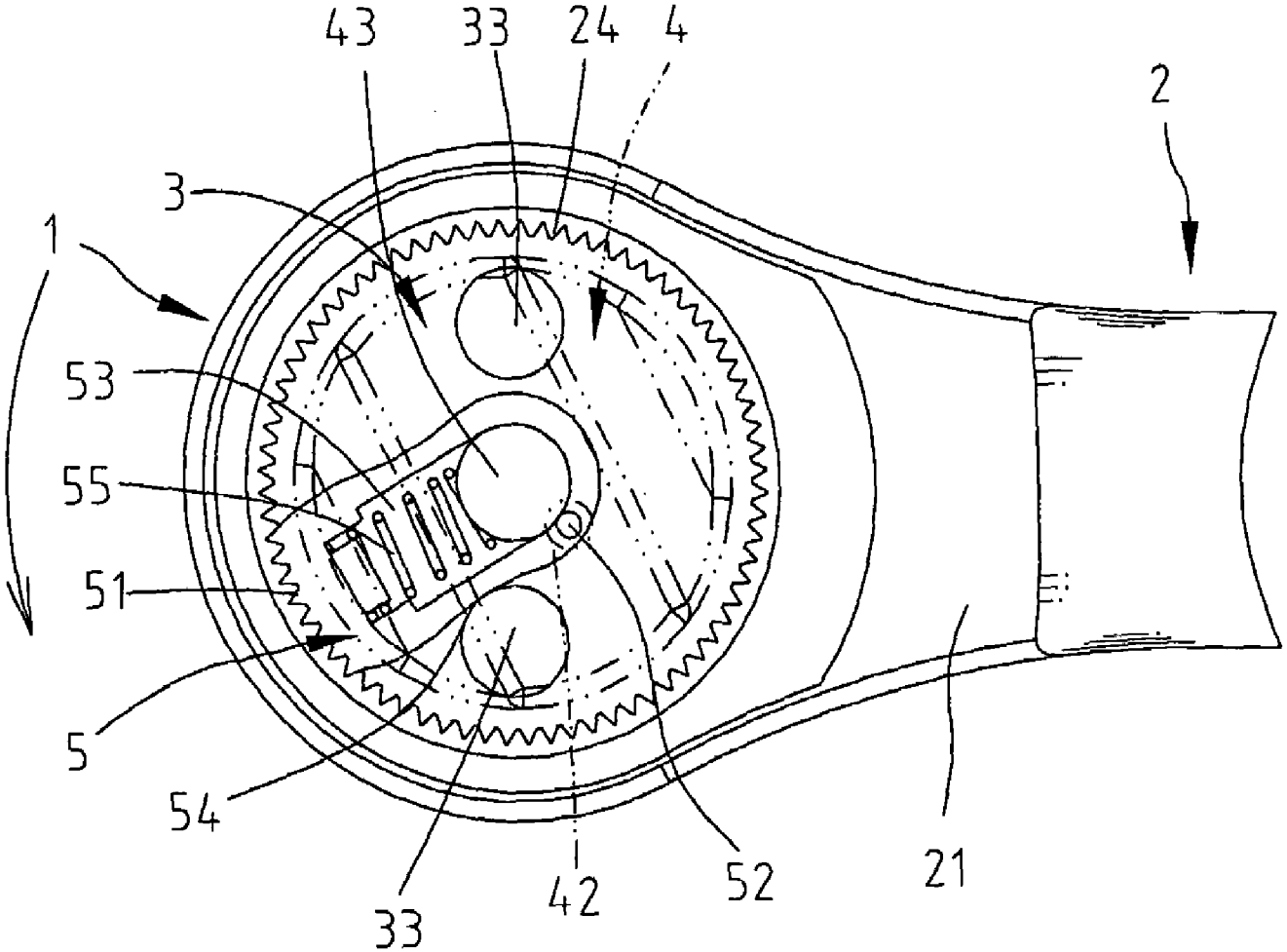

Referring to FIG. 7, to drive the bolt or nut counterclockwise, the user pivots the pawl 50 via pivoting the ridge 41. The left arch-shaped side 54 is engaged with the right stop 33 so as to avoid disengagement of the toothed end 51 of the pawl 50 from the teeth 24. Thus, counterclockwise pivoting of the pawl 50 causes counterclockwise pivoting of the square insert 35. However, clockwise pivoting of the pawl 50 does not cause clockwise pivoting of the square insert 35.

The present invention has been described through detailed illustration of the preferred embodiment. Those skilled in the art can derive many variations from the preferred embodiment without departing from the scope of the present invention. Therefore, the preferred embodiment shall not limit the scope of the present invention defined in the claims.

What is claimed is:

1. A wrench including:

a body including a handle and a ring formed at an end of the handle, with the ring having an internal face and a plurality of teeth formed on the internal face of the ring;

a control device including a disc pivotally received in the ring;

a transmission device including a pawl connected with the disc and formed with a toothed end for engagement with the plurality of teeth and two arc-shaped sides; and a joint including a joint disc rotationally received in the ring, two stops installed on the joint disc each for selective engagement with one of the arc-shaped sides of the pawl, an insert installed beneath the joint disc and a detent attached to the insert.

2. The wrench according to claim 1 further including a C-ring with an external edge and an internal edge, wherein the ring includes an annular groove defined in the internal face thereof for receiving the external edge of the C-ring, and the joint disc includes an annular groove defined in its periphery for receiving the internal edge of the C-ring.

3. The wrench according to claim 1 wherein the joint disc defines two holes each for receiving one of the stops.

4. The wrench according to claim 1 wherein the control device 4 includes a hole defined in the disc, and the pawl includes a rod formed thereon and inserted in the hole defined in the disc of the control device.

5. The wrench according to claim 1 wherein the transmission device includes a spring for biasing the toothed end of the pawl into engagement with the plurality of teeth.

6. The wrench according to claim 1 wherein the control device includes a ridge formed on the disc for engagement with fingers of a user for rotating the control device.

7. A wrench including:

a body including a handle, a ring formed at an end of the handle and with an internal face and a plurality of teeth formed on the internal face of the ring;

a control device including a disc pivotally received in the ring and a stem projecting from the disc and including an upper section, a lower section and an intermediate section thinner than the lower section;

a transmission device including a pawl connected with the disc and formed with a toothed end for engagement with the teeth and two arc-shaped sides, the pawl defining a slot; and a joint including a joint disc received in the ring, an insert installed beneath the joint disc, two stops installed on the joint disc each for selective engagement with one of the arc-shaped sides of the pawl, a disc hole defined in the joint disc and the insert, an insert hole defined in the insert and communicated with the disc hole, and a ball detent trapped in the insert hole for selective engagement with one of the intermediate and lower sections of the stem.

8. The wrench according to claim 7 further including a C-ring with an external edge and an internal edge, wherein the ring includes an annular groove defined in the internal face thereof for receiving the external edge of the C-ring, and the joint disc includes an annular groove defined in its periphery for receiving the internal edge of the C-ring.

9. The wrench according to claim 7 wherein the joint disc defines two holes each for receiving one of the stops.

10. The wrench according to claim 7 wherein the disc hole includes an upper section and a narrow lower section, thus forming an annular shoulder.

11. The wrench according to claim 7 wherein the control device includes a hole defined in the disc, and the transmission device includes a rod formed on the pawl and inserted in the hole defined in the disc of the control disc.

12. The wrench according to claim 7 wherein the transmission device includes a spring for biasing the toothed end of the pawl into engagement with the plurality of teeth.

13. The wrench according to claim 7 further including a spring, wherein the stem includes a shoulder, and the insert includes a shoulder formed on a wall of the disc hole, and the spring is compressed between the shoulder of the stem and the shoulder of the insert.

14. The wrench according to claim 7 wherein the control device includes a ridge formed on the disc for engagement with fingers of a user for rotating the control device.

* * * * *